US008565656B2

(12) United States Patent
Ichikawa et al.

(10) Patent No.: US 8,565,656 B2
(45) Date of Patent: Oct. 22, 2013

(54) IMAGE FORMING APPARATUS WITH GUIDE MEMBER

(75) Inventors: Hiroshi Ichikawa, Okazaki (JP); Hiroshi Nobe, Nagoya (JP); Toshio Furukawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 439 days.

(21) Appl. No.: 12/624,792

(22) Filed: Nov. 24, 2009

(65) Prior Publication Data

US 2010/0129121 A1 May 27, 2010

(30) Foreign Application Priority Data

Nov. 26, 2008 (JP) ..... 2008-300604

(51) Int. Cl.
*G03G 15/16* (2006.01)
*G03G 15/00* (2006.01)

(52) U.S. Cl.
USPC ..... 399/316; 399/388

(58) Field of Classification Search
USPC ..... 399/316, 388, 393, 390
See application file for complete search history.

(56) References Cited

U.S. PATENT DOCUMENTS

| | | | | |
|---|---|---|---|---|
| 6,259,885 | B1 | 7/2001 | Ohkubo et al. | |
| 6,970,676 | B2 * | 11/2005 | Ito et al. | 399/315 |
| 7,031,649 | B2 * | 4/2006 | Matsuura | 399/316 |
| 8,014,709 | B2 * | 9/2011 | Aoi | 399/316 |

FOREIGN PATENT DOCUMENTS

| | | |
|---|---|---|
| JP | H3-063163 | 6/1991 |
| JP | 11-147629 | 6/1999 |
| JP | 2001-139185 | 5/2001 |
| JP | 2001-341887 | 12/2001 |
| JP | 2008-134387 | 6/2008 |

OTHER PUBLICATIONS

Machine Translation of JP 2008-134387 A, obtained on Sep. 20, 2012.*
Office Action for corresponding Chinese Patent Application mailed Sep. 30, 2011.
Office Action in corresponding Japanese Patent Application 2008-300604 mailed Sep. 7, 2010.

* cited by examiner

*Primary Examiner* — David Gray
*Assistant Examiner* — Gregory H Curran
(74) *Attorney, Agent, or Firm* — Banner & Witcoff, Ltd.

(57) ABSTRACT

An image forming apparatus includes photosensitive members which each carry a developer image, transfer members which attract the developer images from the photosensitive members; a sheet housing unit which houses recording sheets; a recording sheet feeding mechanism, which feeds out a recording sheet from within the sheet housing unit and a guide member, which guides the sheet fed out by the recording sheet feeding mechanism towards a position between the photosensitive member and the transfer member. The guide member has a conductive member, which is brought into abutment with a leading end portion of a recording sheet while the recording sheet still remains in the sheet housing unit, and which is grounded electrically and insulation members which the recording sheet is brought into abutment when the leading end portion of the sheet reaches the transfer member.

9 Claims, 5 Drawing Sheets

IMAGE FORMING APPARATUS WITH GUIDE MEMBER

CROSS REFERENCE TO RELATED APPLICATION

The present application claims priority from Japanese Patent Application No. 2008-300604 filed on Nov. 26, 2008, the disclosure of which is incorporated herein by reference in its entirety.

BACKGROUND OF THE INVENTION

The present invention relates to an image forming apparatus which includes a guide chute for guiding a recording sheet from a sheet feeding tray (a sheet housing unit) to a transfer position (between a photosensitive member and a transfer member).

In general, there are known image forming apparatuses which include a sheet feeding tray for housing recording sheets, a recording sheet feeding mechanism for feeding out recording sheets within the sheet feeding tray to the outside of the sheet feeding tray and a guide chute for guiding recoding sheets fed out by the sheet feeding mechanism towards a transfer position. Conventionally, there is known an image forming apparatus in which a guide chute is grounded via a high-resistance resistor. According to this technique, even though a transfer bias is applied to a transfer member in a state that a recording sheet containing moisture is in contact with both the guide chute and the transfer member, the leakage of transfer current from the transfer member via the recording sheet and the guide chute is suppressed by the high-resistance resistor.

SUMMARY

However, in the related-art technique, static current stored in the recording sheet is prevented from escaping via the guide chute when the recording sheet is brought into sliding contact with the guide chute and remains within the sheet feeding tray because the guide chute is grounded via the high-resistance resistor. Then, the static current stored within the sheet feeding tray described above causes a plurality of recoding sheets to stick to each other by virtue of static current stored within the sheet feeding tray, thereby causing a so-called double sheet feeding problem wherein a plurality of recording sheets are fed out from the sheet feeding tray in a superposed fashion.

An object of the present invention is to provide an image forming apparatus which can suppress the occurrence of both double sheet feeding of recording sheets and leakage of transfer current.

Thus according to an aspect of an exemplary embodiment of the present invention, there is provided an image forming apparatus including a photosensitive member which carries a developer image, a transfer member to which a transfer bias is applied to attract the developer image from the photosensitive member, a sheet housing unit, which houses recording sheets, a recording sheet feeding mechanism, which feeds out recording sheets from within the sheet housing unit to the outside of the sheet housing unit, a guide chute, which guides a recording sheet fed out by the recording sheet feeding mechanism towards a position between the photosensitive member and the transfer member, and an insulation member, wherein the guide chute has a conductive member which is brought into abutment with a leading end portion of the recording sheet when the recording sheet remains within the sheet housing unit and is grounded electrically and an insulation member which is brought into abutment with the recording sheet when the leading end portion of the recording sheet reaches the transfer member.

According to an aspect of an exemplary embodiment of the present invention, there is provided an image forming apparatus comprising: a photosensitive member which carries a developer image; a transfer member to which a transfer bias is applied to attract the developer image from the photosensitive member; a sheet housing unit, which houses recording sheets; a feeding roller, which is situated only at a central portion in a width direction of the recording sheet, and which feeds out a recording sheet from within the sheet housing unit to the outside of the sheet housing unit; and a guide member which is disposed at a downstream side of the feeding roller and has a substantially arc-like shape, said guide member guiding the recording sheet at a radially inner surface thereof to change a transport direction of the recording sheet, wherein the guide member includes a conductive member having a substantially arc-like shape; and an insulation member which covers a radially inner surface of the conductive member such that a central portion of the conductive member is exposed.

According to an aspect of an exemplary embodiment of the present invention, there is provided A guide member for guiding a recording sheet, comprising: a conductive member having a substantially arc-like shape; and an insulation member which covers a radially inner surface of the conductive member such that a central portion of the conductive member is exposed, wherein the sheet member is guided by the insulation member to be brought into contact with and then be separated from the conductive member.

DETAILED DESCRIPTION OF EXEMPLARY EMBODIMENTS

Figure 1:
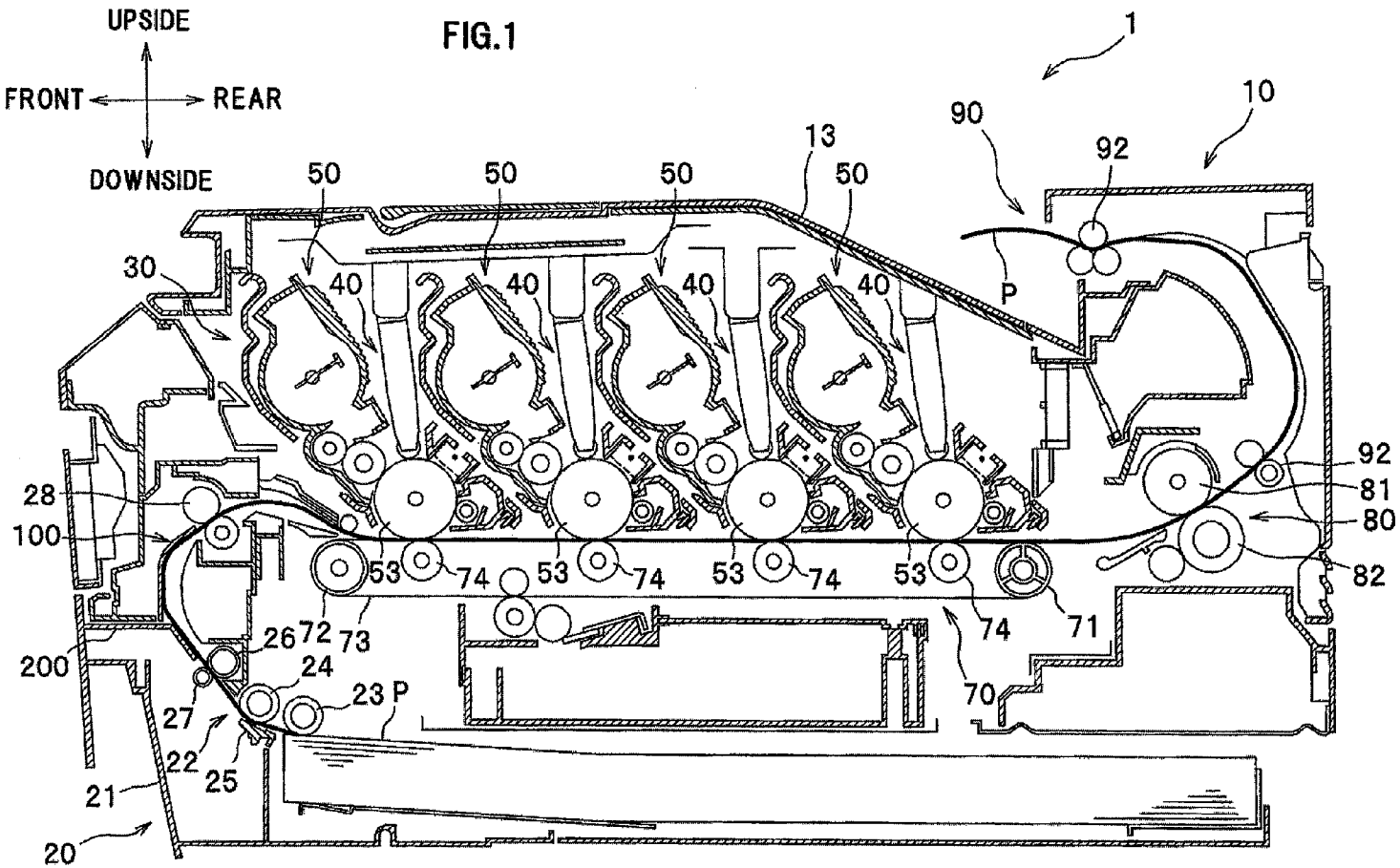
FIG. 1 is a sectional view showing an overall configuration of a color printer as an example of an image forming apparatus.

Next, referring to the drawings as required, an embodiment of the invention will be described in detail. Note that in the following description, firstly, a brief description of the overall configuration of the color printer will be made, and thereafter details of characteristic parts of the invention will be described.

As is shown in FIG. 1, a color printer 1 includes a sheet feeding unit 20 for feeding sheets P which constitute, an image forming unit 30 for forming an image on a sheet P so fed and a sheet discharging unit 90 for discharging the sheet P on which the image is formed.

The sheet feeding unit 20 mainly includes a sheet feeding tray 21 (an example of a sheet housing unit) for housing sheets P, a sheet feeding mechanism 22 (an example of a sheet feeding mechanism) for feeding out sheets P in the sheet feeding tray 21 to the outside of the sheet feeding tray 21, and a guide chute 100 for guiding sheets P which are fed out by the sheet feeding mechanism 22 towards the image forming unit 30 (between a photosensitive member and a transfer member). The sheet feeding mechanism 22 mainly includes a feed roller 23, a separation roller 24, a separation pad 25, a transport roller 26, a paper dust removing roller 27, and a registration roller 28.

Specifically, in this embodiment, the guide chute 100 guides a sheet P to the image forming unit 30 via the registration roller 28 and a guide member (whose reference number is omitted). In addition, a transport path (a transport path from the sheet feeding tray 21 to a transfer roller 74) of sheets P is formed by the guide chute 100 described above and has a substantially arc-like shape. Note that detailed constructions of the guide chute 100 and the sheet feeding mechanism 22 will be described later.

In the sheet feeding unit 20 described above, sheets P in the sheet feeding tray 21 are separated to be fed upwards sheet by sheet, and paper dust is removed from a sheet P while the sheet P is passing between the transport roller 26 and the paper dust removing roller 27, whereafter the sheet P is turned to change its direction towards the rear by the chute 100 so as to be sent to the image forming unit 30.

The image forming unit 30 mainly includes four LED units 40, four process cartridges 50, a belt unit 70 and a fixing unit 80.

The LED unit 40 includes a plurality of LEDs for exposing a corresponding photosensitive drum 53, which will be described later.

The process cartridges 50 are arranged side by side in a front-rear direction and each process cartridge 50 is configured to include a photosensitive drum 53 which is an example of a photosensitive member which carries a toner image (a developer image) thereon, a charger, a developing roller, a toner accommodation compartment and the like, which are known and whose reference numerals are omitted here.

The belt unit 70 mainly includes a drive roller 71, a driven roller 72, a transport belt 73 and transfer rollers 74, which are examples of a transfer member.

The drive roller 71 and the driven roller 72 are arranged in parallel while being spaced apart from each other in the front-rear direction, and the transport belt 73, which is made up of an endless belt, is provided so as to extend therebetween. The transport belt 73 is disposed so as to be opposed to the respective photosensitive drums 53. In addition, there are disposed four transfer rollers 74 inside the transport belt 73 so as to be opposed to the corresponding photosensitive drums 53 to thereby hold the transport belt 73 therebetween. A transfer bias is applied to these transfer rollers 74 through a constant current control at the time of transfer.

The fixing unit 80 includes a heating roller 81 and a pressing roller 82, which presses against the heating roller 81.

In the image forming unit 30 configured as described above, firstly, a surface of each photosensitive drum 53 is charged uniformly by the charger and is thereafter exposed by the corresponding LED unit 40. By this exposure, a potential of the exposed portion of the photosensitive drum 53 is lowered, whereby an electrostatic latent image based on image data is formed on the photosensitive drum 53. Thereafter, toner is supplied to the electrostatic latent image formed by the corresponding developing roller, whereby a toner image is carried on the photosensitive drum 53.

Next, a transfer bias is applied to each transfer roller 74, while a sheet P is being transported between the corresponding photosensitive drum 53 and the transport belt 73, whereby the toner image formed on the photosensitive drum 53 is attracted to the transfer roller 74 so as to be transferred onto the sheet P. Thereafter, the sheet P passes between the heating roller 81 and the pressing roller 82, whereby the toner image transferred on to the sheet P is thermally fixed.

The sheet discharging unit 90 mainly includes a plurality of pairs of transport rollers 92 for transporting sheets P. The sheet P having the toner image which has been transferred thereto and thermally fixed is discharged to the outside of an apparatus main body 10 for accumulation in the sheet discharging tray 13.

<Detailed Construction of Guide Chute>

Next, a detailed construction of the guide chute 100 will be described. In the drawings to be referred to, FIG. 2A is a perspective view showing the guide chute 100 viewed from therebelow and FIG. 2B is a sectional view of a central portion in a left-right direction of the guide chute 100.

Figure 2A:
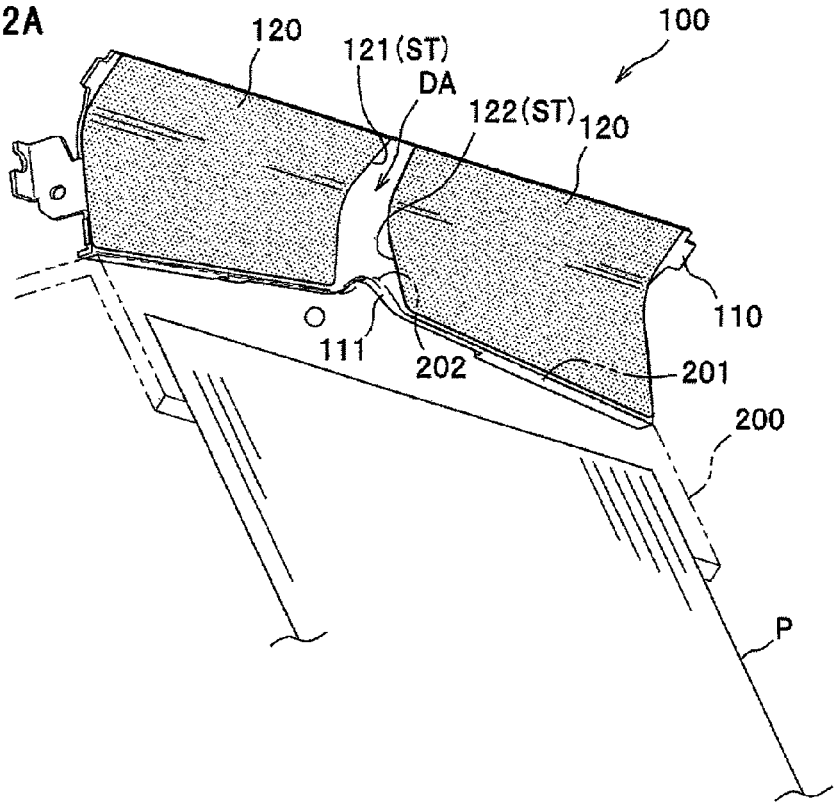
FIG. 2A is a perspective view showing a guide chute viewed from therebelow.
Figure 2B:
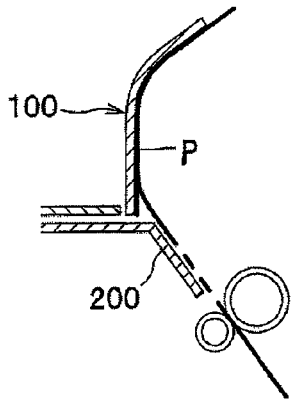
FIG. 2B is a sectional view of a central portion in a left-right direction of the guide chute.

As shown in FIG. 2A, the guide chute 100 is configured to include a metal plate 110 which is an example of a conductive member and two resin sheets 120 which are each an example of an insulation member.

The metal plate 110 is formed to have substantially the same width as that of a sheet P and is formed to have a shape which matches the substantially arc-shaped transport path of the sheets P. In addition, the metal plate 110 is disposed radially outward side of the substantially arc-shaped transport path (refer to FIG. 1) and is electrically grounded. In addition, the metal plate 110 may be grounded via an electric element such as an electric resistance element, a Zener diode or the like.

In addition, a recessed portion 111 is formed at a central portion in a left-right direction of the metal plate 110 (a width direction of a sheet P) at a lower end thereof (an upstream-side end in a sheet transport direction), and the recessed portion 111 is made to recede towards a downstream side of the sheet transport direction. This recessed portion 111 is formed so as to avoid a guide plate 200, which is provided upstream of the metal plate 110 in the sheet transport direction. Here, the "central portion in the left-right direction (the width direction of a sheet P)" denotes a "portion which faces a central portion in the width direction of a sheet P."

Here, the guide plate 200 is, as is shown in FIG. 1, installed between the guide chute 100 and the paper dust removing roller 27, so as to guide a sheet P which is sent from the paper dust removing roller 27 to the guide chute 100. As is shown in FIG. 2A, a downstream end portion 201 of the guide plate 200 in the sheet transport direction is formed as a projecting portion 202 at a central portion in a left-right direction of the guide plate 200 and is formed to be inclined towards the upstream side with a downstream end portion 201 that extends towards left and right ends thereof. The projecting portion 202 is made to project towards the downstream side in the sheet transport direction.

In the configuration described above, when a rear end portion of a sheet P passes the downstream end portion 201 of the guide plate 200, both sides of the sheet P in the left-right direction are first brought into abutment with the guide chute 100, and then, a central portion in the left-right direction of the sheet P is brought into gradual abutment with the guide chute 100. Because the central portion of the sheet P is brought into gradual abutment with the guide chute 100 the noise produced by the abutment of the sheet P with the guide chute 100 is less than the noise produce when the rear end portion of the sheet P, which has passed the downstream end portion 201 of the guide plate 200, is brought into abutment with the guide chute 100 at one time.

The resin sheets 120 are affixed to the metal plate 110 so as to cover both left- and right-hand side portions (parts) of the metal plate 110 so that only a central portion in a left-right direction of the metal plate 110 is exposed to the transport path side. More specifically, the resin sheets 120 are affixed to the portions of the metal plate 110 other than the recessed portion 111, i.e. portions which lie further outward in the left-right direction than the recessed portion 111.

Due to the resin sheets 120 being affixed in the way described above, an exposed area DA where the metal plate 110 of the guide chute 100 is exposed at the central portion in the left-right direction of the metal plate 110 is formed continuously from one end of the metal plate 110 to the other end of the metal plate 110 in the transport direction of sheets P. In addition, because the resin sheets 120 are affixed on a transport surface (the same plane) of the metal plate 110, the resin sheets 120 are made to project towards the transport path side further than the metal plate 110, and end faces 121, 122 of the resin sheets 120 form individual riser faces ST between upper surfaces of the resin sheets 120 and an upper surface of the central exposed portion of the metal plate 110.

In addition, as is illustrated in the figure, the right-hand end face 121 of the resin sheet 120, which is affixed on the left-hand side of the metal plate 110 is formed so as to be inclined gradually towards the right-hand side as the resin sheet 120 extends towards the downstream side in the sheet transport direction. Conversely, the left-hand end face 122 of the resin sheet 120, which is affixed on the right-hand side of the metal plate 110 is formed so as to be inclined gradually towards the left-hand side as the resin sheet 120 extends towards the downstream side in the sheet transport direction. By this configuration, the exposed area DA is formed so as to be tapered as it extends towards the downstream side in the transport direction of sheets P.

<Detailed Construction of Sheet Feeding Mechanism>

Next, a detailed construction of the sheet feeding mechanism 22 will be described.

The sheet feeding mechanism 22 shown in FIG. 1 is configured so that a transport force at the portion of the guide chute 100 which corresponds to the exposed area DA becomes stronger than transport forces at the areas of the guide chute 100, which are covered with the resin sheets 120.

Specifically, in this embodiment, by the transport roller 26 and the paper dust removing roller 27 being provided so as to be situated only at the central portion in the width direction of the sheet P, the transport force at the portion corresponding to the exposed area DA becomes stronger. By this configuration, a leading end side of a sheet P which is transported by the transport roller 26 and the paper dust removing roller 27 is pressed towards the exposed area DA side along the riser faces ST at a central portion of the leading end side of the sheet P to thereby be formed into a curved shape which projects towards the exposed area DA.

In addition, the registration roller 28 is formed to have substantially the same width as that of the sheet P. By this configuration, the shape of a peripheral portion of a portion of the sheet P which is held by the registration roller (in particular, a portion of the sheet P which lies further upstream in the sheet transport direction than the registration roller 28) is not curved but is allowed to remain planar.

<Function of Guide Chute>

Figure 3B:
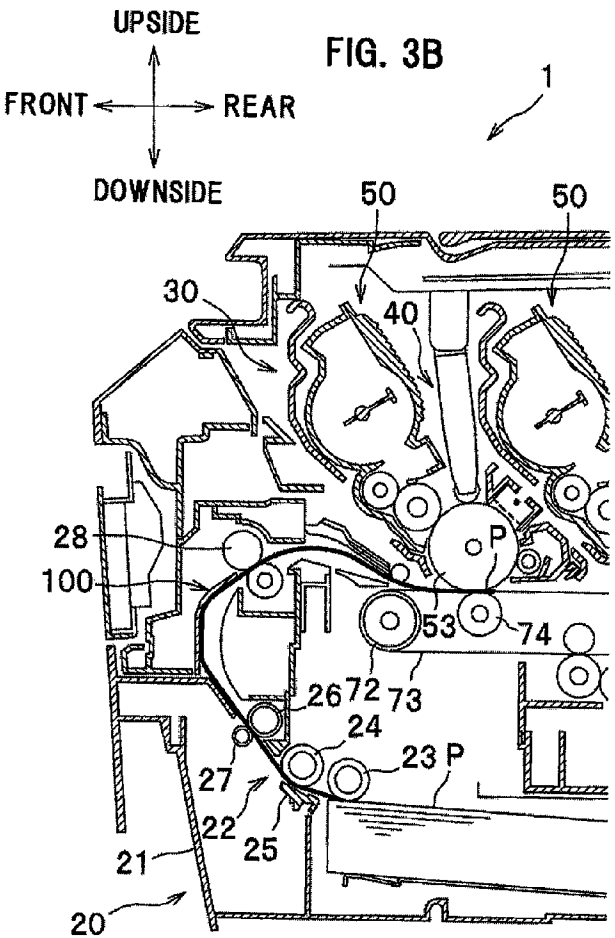
FIG. 3B is a sectional view showing a state in which the leading end of the sheet reaches a transfer roller.
Figure 3A:
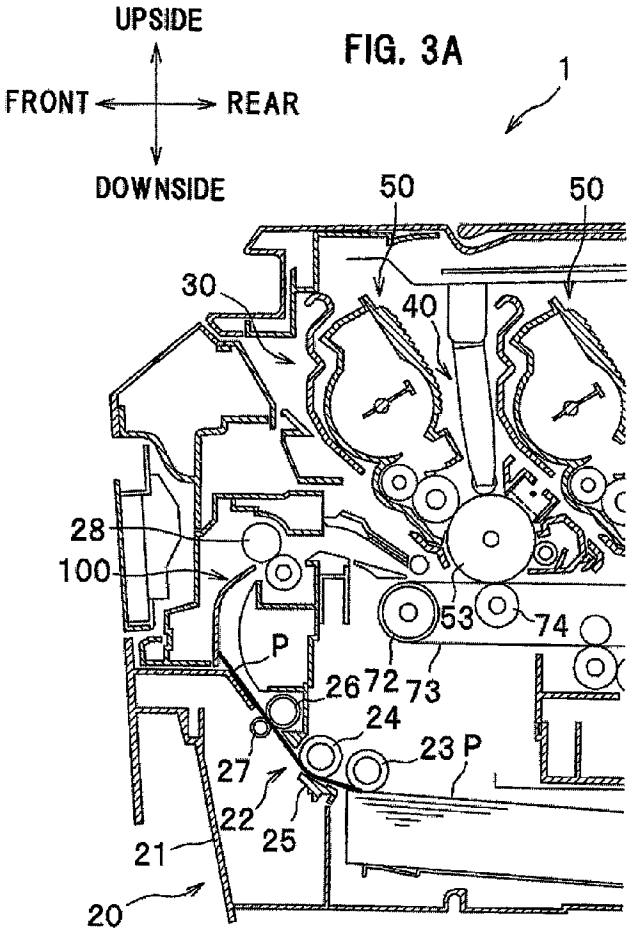
FIG. 3A is a sectional view showing a state in which a leading end of a sheet is brought into abutment with the guide chute.

Next, the function of the guide chute 100 will be described. In the drawings to be referred to, FIG. 3A is a sectional view showing a state in which a leading end of a sheet is brought into abutment with the guide chute, and FIG. 3B is a sectional view showing a state in which the leading end of the sheet has reached the transfer roller. In addition, FIGS. 4A and 4B are a plan view and a sectional view, respectively, which show a state in which a central portion of the leading end of the sheet is brought into abutment with the exposed area, and FIGS. 5A and 5B are a plan view and a sectional view, respectively, which show a state in which the sheet moves away from the exposed area.

As is shown in FIG. 3A, when a printing command is sent to the color printer 1, a sheet P within the sheet feeding tray 21 is sent out towards the guide chute 100 by the sheet feeding mechanism 22. As this occurs, a leading end of the sheet P which has passed between the transport roller 26 and the paper dust removing roller 27 is, as is shown in FIG. 2A, brought into abutment with the guide plate 200 to thereby be guided to the guide chute 100. Then, when a central portion in the width direction of a leading end of the sheet P is brought into abutment with the guide chute 100, the central portion in the width direction enters between the pair of riser faces ST to thereby be curved so as to project towards the exposed area DA.

Figure 4A:
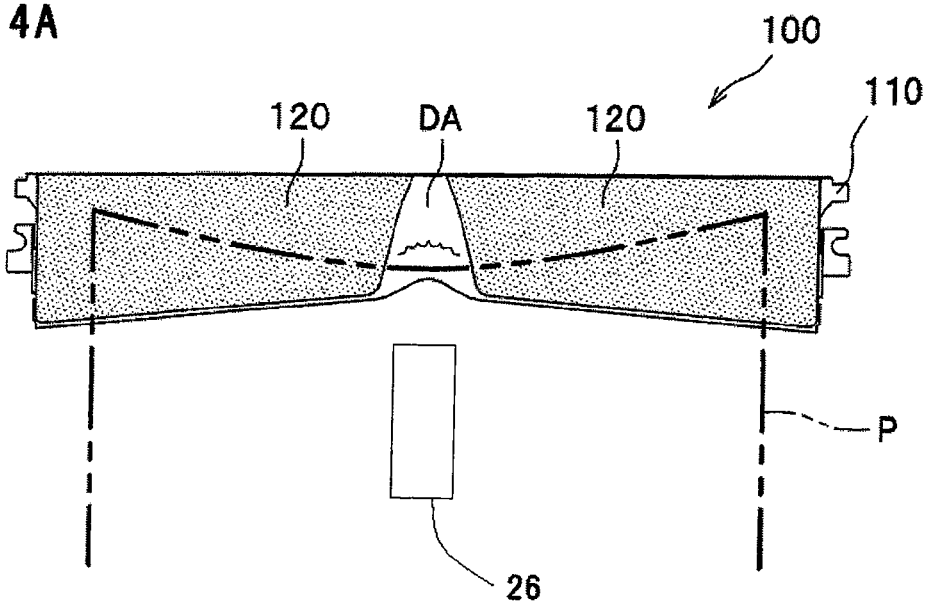
FIG. 4A is a plan view and FIG. 4B is a sectional view, which both show a state in which a central portion of the leading end of the sheet is brought into abutment with an exposed area.
Figure 4B:
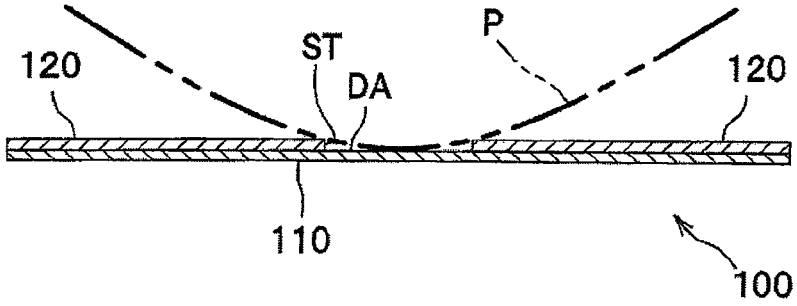
Figure 5A:
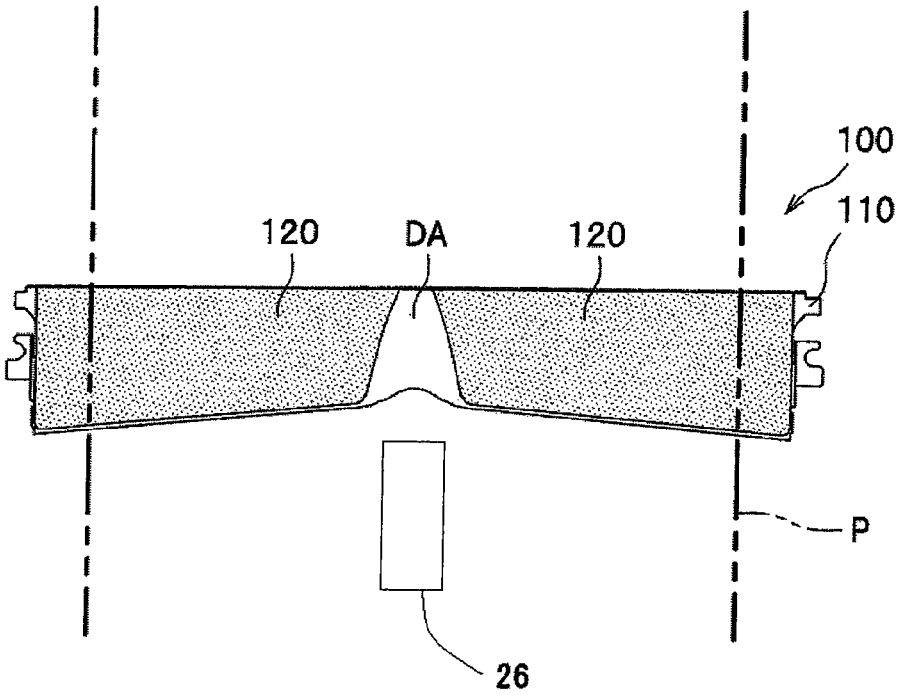
FIG. 5A is a plan view and FIG. 5B is a sectional view, which both show a state in which the sheet is separated from the exposed area.
Figure 5B:
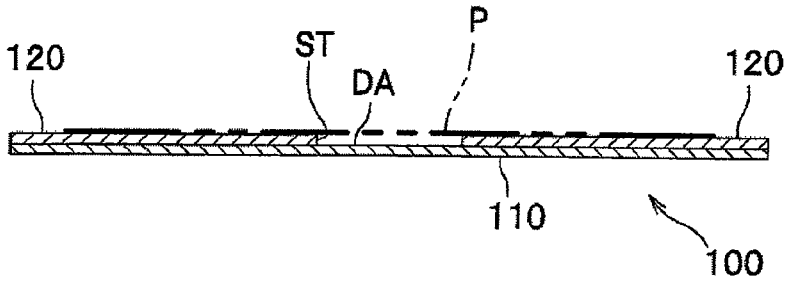

Then, in the sheet P whose leading end portion is curved in the way described above, the leading end portion is brought into abutment with the exposed area DA of the metal plate 110 as is shown in FIGS. 4A, 4B with a rear portion thereof still remaining in the sheet feeding tray 21 (refer to FIG. 3A), whereby the double sheet feeding of more than one sheet P can be suppressed since static electricity stored in the sheet P is allowed to escape via the metal plate 110.

Thereafter, as is shown in FIG. 3B, when the leading end portion of the sheet P arrives at the transfer roller 74, a portion of the sheet P which lies around the registration roller 28 is made substantially planar. By this, as is shown in FIGS. 5A, 5B, since the sheet P floats above the exposed area DA so as to be brought into sliding contact with the resin sheets 120 only, the leakage of transfer current from the transfer roller 74 via the moisture containing sheet P and the metal plate 110 can be suppressed.

In particular, in this embodiment, when a downstream end in the sheet transport direction of the guide chute 100 is configured to lie close to the registration roller 28, an upstream side portion of the portion of the sheet P which is transported by the registration roller 28 is brought into strong abutment with the guide chute 100. Because of this, the configuration in which the sheet P is brought into sliding contact with only the resin sheets 120 becomes an effective measure against the leakage of transfer current.

Thus, according to what has been described heretofore, the following advantages can be obtained in the embodiment.

Since the sheet P which is sent out from the sheet feeding tray 21 is brought into abutment with the metal plate 110 and the sheet P that has arrived at the transfer roller 74 is brought into abutment with the resin sheets 120, both the double sheet feeding of more than one sheet P and leakage of transfer current can be suppressed.

Since the guide chute 100 can easily be fabricated by part of the metal plate 110 being covered with the resin sheets 120, the fabrication costs can be reduced.

Since the exposed area DA is formed from the one end to the metal plate 110 the other end of the metal plate 110 in the sheet transport direction, the sheet P can be prevented from being caught on the riser faces ST formed by the metal plate 110 and the resin sheets 120, and the sheet P can be transported smoothly.

Since in this embodiment the left and right resin sheets 120 project towards the transport path side further than the metal plate 110 and the exposed area DA is formed at the central portion of the metal plate 110 in the width direction of the sheet, the central portion in the width direction of the sheet P transported by the sheet feeding mechanism 22 with strong transport force can be forced between the pair of riser faces ST. Because of this configuration, static electricity stored in the sheet P can be discharged in an ensured fashion since the central portion in the width direction of the sheet P is curved to be brought into contact with the metal plate 110 in an ensured fashion.

Further, since the resin sheets 120 are configured to project towards the transport path further than the metal plate 110, the rear portion of the sheet P which has arrived at the transfer roller 74 can be separated from the metal plate 110 in an ensured fashion.

Because the exposed area DA is formed to taper as it extends towards the downstream side in the sheet transport direction the exposed area DA is smaller compared to the construction where the exposed area is formed in to have a constant width. Thus, it is made more difficult for the sheet P whose leading end portion has arrived at the transfer roller 74 to hit the metal plate 110. In addition, the central portion at the leading end of the sheet P, which is in contact with the exposed area DA of the metal plate 110, is caused to move apart from the exposed area DA by virtue of a repulsion force produced when the leading end of the sheet P is gradually forced to be contracted by the respective end faces of the resin sheets 120, which are gradually tapered. Further the metal plate 110 and the sheet P can be put into a non-contact state before the sheet P reaches the transfer roller 74. Thus, the leakage of transfer current from the transfer roller 74 can be suppressed in an ensured fashion.

Since the sheet feeding mechanism 22 is configured so that the transport force at the portion corresponding to the exposed area DA becomes stronger than at the areas which are covered with the corresponding resin sheets 120, the central portion in the width direction of the sheet P which corresponds to the exposed area DA can be forced between the pair of riser faces ST so as to be brought into abutment with the exposed area DA in an ensured fashion.

In the construction of the embodiment where the guide chute 100 is formed into the arc-like shape which matches the arc-like transport path and is formed on the radially outer side of the transport path, the advantages of embodiments of the invention are particularly exhibited because the double sheet feeding of more than one sheets P and leakage of transfer current are made difficult by the leading end portion and rear portion of the sheet P being brought into strong sliding contact with the guide chute 100.

Since the resin sheets 120 are affixed to the portions of the metal plate 110 other than the recessed portion 111, the riser faces ST are not formed at the portion where the sheet P tends to be caught easily (i.e. the central portion in the width direction), and the sheet P can be transported smoothly.

Note that embodiments of the invention are not limited to the embodiment described above but can be applied to various forms including those described below.

In the above discussed embodiment, while the guide chute 100 is configured by the resin sheets 120 being affixed to the metal plate 110 having substantially the same width as that of the sheet P, the invention is not limited thereto. For example, the guide chute may be configured with a pair of insulation members being installed on both left- and right-hand sides of a conductive member, which have a width narrower than that of the sheet.

In the above embodiment, while the central portion of the metal plate 110 is exposed, the invention is not limited thereto, and hence, both the left- and right-hand side portions of the metal plate 110 may be made to be exposed. Note that as this occurs, the guide and the like may be provided so that the sheet P is curved in an opposite direction to that discussed in the above embodiment.

In the above embodiment, while the sheet P is curved by the central portion in the width direction of the sheet P being forced between the pair of riser faces ST of the guide chute 100 by increasing the transport force at the central portion in the width direction of the sheet P by the transport roller 26 and the paper dust removing roller 27, which are provided only at the central portion in the width direction, the invention is not limited thereto. For example, the sheet may be curved by the guide so as to be brought into contact with the conductive member before the sheet reaches the guide chute.

In the above embodiment, while the invention is applied to the color printer 1, the invention is not limited thereto, and hence, the invention may be applied to other image forming apparatuses such as a monochrome printer, a tandem or multi-path intermediate belt transfer color printer, a four-cycle color printer, a copier or a multi function device, for example.

In the above embodiment, while the metal plate 110 is used as the conductive member, the invention is not limited thereto but a plate formed of a conductive resin, for example, may be adopted. In addition, the insulation member is not limited to the resin sheets 120 but may be made up of a glass plate or a rubber sheet whose surface is formed smooth, for example.

In the above embodiment, while the photosensitive drums 53 are adopted as the photosensitive members, the invention is not limited thereto, and hence, a belt-like photosensitive member may be adopted.

In the above embodiment, while the transfer rollers 74 are adopted, the invention is not limited thereto, and hence, a member that does not have a roller shape may be adopted.

In the above embodiment, while the resin sheets 120 are affixed to the portions of the metal plate 110 other than the recessed portion 111, the invention is not limited thereto, and hence, for example, in the event that a recessed portion is formed moderately over the entirety of the conductive member in the sheet width direction, insulation members may be affixed to portions of the recessed portion other than a bottom portion thereof. Here, for example, in the event that the recessed portion is made up of a pair of side surfaces which slope from both ends towards a center in the width direction and a cylindrically curved bottom surface which connects the respective side surfaces together, the bottom portion of the recessed portion means the cylindrically curved bottom surface.

In the above embodiment, while two resin sheets are affixed to both sides of the metal plate, a single resin sheet may be employed and affixed to the metal plate in such a manner that a central portion of the metal plate is exposed from the resin sheet.

What is claimed is:

1. An image forming apparatus comprising:

a photosensitive member configured to carry a developer image;

a transfer member to which a transfer bias is applied to attract the developer image from the photosensitive member;

a sheet housing unit configured to house recording sheets;

a recording sheet feeding mechanism configured to feed out a recording sheet from within the sheet housing unit to an outside of the sheet housing unit; and a guide member configured to guide a recording sheet fed out by the recording sheet feeding mechanism towards a position between the photosensitive member and the transfer member, wherein the guide member has:

a conductive member configured to be brought into abutment with a leading end portion of the recording sheet while the recording sheet remains within the sheet housing unit and which is grounded electrically; and an insulation member configured to be brought into abutment with the recording sheet when the leading end portion of the recording sheet reaches the transfer member, wherein a part of the conductive member is covered by the insulation member, the insulation member projects further towards a transport path side than the conductive member, an area of the conductive member exposed from the insulation member is formed at a central portion in a width direction of the recording sheet, and the exposed area of the conductive member is formed to be tapered as the conductive member extends in a transport direction toward the downstream side.

2. The image forming apparatus according to claim 1, wherein the area of the conductive member exposed from the insulation member is formed continuously from a first end to a second end of the conductive member in the transport direction of recording sheet.

3. The image forming apparatus according to claim 1, wherein the sheet feeding mechanism provides a transport force at the exposed area of the conductive member that is stronger than a transport force provided at the area of the conductive member covered by the insulation member.

4. The image forming apparatus according to claim 1, wherein the transport path for the recording sheets from the sheet housing unit to the transfer member has a substantially arc-like shape, and the guide member is formed to have a shape which matches the substantially arc-shaped transport path and is disposed radially outward of the substantially arc-shaped transport path.

5. The image forming apparatus according to claim 1, wherein:

a recessed portion is formed at an upstream-side end of the conductive sheet in a sheet transport direction of the recording sheet, and is made to recede towards a downstream side of the sheet transport direction, and the insulation member is affixed to a portion of the conductive member other than a bottom portion of the recessed portion.

6. The image forming apparatus according to claim 1, wherein when the leading end portion of the recording sheet reaches the transfer member, the recording sheet is separated from the conductive member.

7. The image forming apparatus according to claim 1, wherein an area of the insulation member is larger than the area of the conductive member exposed from the insulation member.

8. The image forming apparatus according to claim 1, wherein the insulation member is a resin sheet which is affixed to the conductive member.

9. An image forming apparatus comprising:

a photosensitive member configured to carry a developer image;

a transfer member to which a transfer bias is applied to attract the developer image from the photosensitive member;

a sheet housing unit configured to house recording sheets;

a recording sheet feeding mechanism configured to feed out a recording sheet from within the sheet housing unit to an outside of the sheet housing unit; and a guide member configured to guide a recording sheet fed out by the recording sheet feeding mechanism towards a position between the photosensitive member and the transfer member, wherein the guide member has:

a conductive member configured to be brought into abutment with a leading end portion of the recording sheet while the recording sheet remains within the sheet housing unit and which is grounded electrically; and an insulation member configured to be brought into abutment with the recording sheet when the leading end portion of the recording sheet reaches the transfer member and configured to cover a part of the conductive member, the insulation member projecting further towards a transport path side than the conductive member, wherein the insulation member includes a first surface facing the recording sheet and a second surface opposite to the first surface, and the conductive member is provided at the second surface of the insulation member.

* * * * *